United States Patent [19]

Yaklin

[11] Patent Number: 4,548,022

[45] Date of Patent: Oct. 22, 1985

[54] TAPING MACHINES

[75] Inventor: Leonard L. Yaklin, Houston, Tex.

[73] Assignee: American Specialty & Supply, Inc., Houston, Tex.

[21] Appl. No.: 538,146

[22] Filed: Oct. 3, 1983

[51] Int. Cl.[4] ..... B65B 61/00

[52] U.S. Cl. ..... 53/415; 53/137; 156/486; 156/477.1

[58] Field of Search ..... 53/137, 415; 156/468, 156/475, 477.1, 478, 479, 480, 482, 486

[56] References Cited

U.S. PATENT DOCUMENTS

| | | | |
|---|---|---|---|
| 2,787,396 | 4/1957 | Christensson | 156/477.1 |
| 3,229,594 | 1/1966 | De La Coussaye | 156/486 X |
| 3,954,550 | 5/1976 | Patterson | 156/486 |
| 4,227,955 | 10/1980 | Woods et al. | 156/468 X |

*Primary Examiner*—Paul A. Bell

[57] ABSTRACT

A machine for applying a segment of adhesive tape from a roll of tape automatically in which a bag member to be sealed is positioned under the end of a strip of adhesive tape, the tape is mechanically applied to the top and end of the bag member, the tape is cut from the strip to leave an end below the bag member, a wiper applies sealing pressure to apply the cut segment of the tape to the top, bottom and side of the bag member, with the mechanisms for applying the tape, cutting the tape and applying sealing pressure operating in sequence to return to an initial position for a subsequent operation.

14 Claims, 13 Drawing Figures

TAPING MACHINES

BACKGROUND OF THE INVENTION

This invention relates to taping machines, and more particularly to tape machines for automatically sealing packages or containers by applying an adhesive tape to a package.

Heretofore, large bags containing bulk chemicals have tended to leak materials after filling of the bags. Because of the leakage, it has been necessary to tape the package closed by hand labor.

Although it will be appreciated that the invention has broader applications, the particular type of packaging which the present invention addresses, relates to 50 pound sacks or bags of chemicals. The package container or bag has a generally elongated rectangular shape and is constructed of heavy paper. The package container, may or may not, contain a plastic liner insert. The package container is preformed and presealed and has an opening in a fold at one of its bottom ends. In the bottom flap of the package container which defines the opening to the bag is a plastic tubular member through which a nozzle is inserted. The chemicals are injected into the package container through the tubular member to the proper volume or weight. When the proper volume or weight is otained, the injection nozzle is withdrawn and the flap with the plastic tubular member closes and is intended to seal the contents within the package container. Unfortunately, the subsequent handling of the filled package container, more often than not, causes the flap and tubular member to open so that materials leak from the package container.

In an effort to resolve the problem of leakage, the package container is typically provided with an additional seal by means of adhesive plastic sealing tape which attaches to the package container and generally fits over the side panels and the bottom of the package container. It is not necessary to have a neat appearing seal and thus when a rectangular strip of sealing tape is applied to the package container, it typically will attach to the front and rear sides and the bottom and adhers to itself and to the package container. Generally speaking, the sealing of package containers by hand involves two laborers and attendant time to perform the sealing operation on each package container in an assembly line.

The present invention provides a method and apparatus for automatically applying a sealing tape to a corner of a package container or bag.

The system of the present invention involves a belt conveyer for transporting filled bags through a tape sealing apparatus. There are side by side conveyer belts means with one of the conveyer belts means being continuous from end to end of the apparatus. The other conveyer belt means is divided into separate belt conveyer sections so as to form an opening along its length to accomodate the sealing operation performed on the bag. At the forward and rearward ends of conveyers belt means are transverse forward and rearward gate members which respectively stop a bag from entering the apparatus while the sealing operation occurs and for stopping a bag in position for a sealing operation to occur in the apparatus. After a bag passes through the forward gate member it actuates a first trigger mechanism which lowers both gate members. Thereafter, the bag actuates a second trigger mechanism which stops the conveyer belts and starts the sealing operation. Also as a bag is transported by the conveyer belts toward the rearward gate member, a depending adhesive strip of tape with its ahdesive side facing the oncoming bag first engages the top end surface of the bag and then is dragged across the upper side of the bag until the bag stops at the rearward gate member. At this position, a free end of an adhesive tape strip is positioned over the upper side of the bag. The strip of tape also extends outwardly from the bag, that is over the side of the bag. When the sealing operation is commenced by the bag reaching the rearward gate member, a vertically reciprocating taping mechanism, which is located rearward of the rear end of the bag, moves downwardly. As the tape mechanism moves downwardly, a roller on the tape mechanism engages the upper surface of the adhesive tape on the upper side of the bag and presses the tape firmly onto the upper surface bag. The roller, as the tape mechanism is moved downwardly, is pivoted on a frame so that the strip of tape is unlocked with respect to a locking mechanism and so that a roll of tape can unroll while the tape is applied to the bag. The roller, after engaging the upper side of the bag, moves from the upper side of the bag to the bottom end of the bag and presses the tape to the bottom end of the bag. Subsequently, the roller is displaced to a position below the bag. At this point of the operation, the tape is adhered to the upper surface of the bag, the bottom end surface of the bag and has a section disposed below the bottom end surface of the bag. Also, there is an overlapping adhesive portion of the tape extending outwardly of the side of the bag. At the bottom of the travel of the tape mechanism, a switch is triggered to actuate a pivotally mounted wiper arm located to one side of the conveyer belts. The wiper arm is pivotally moved to bring a U-shaped wiper member into a positon rearward of the bag and behind the semi-attached tape. The U-shaped wiper member has rubber blated wipers and is sized to conform to the dimensions of the bag so that as the wiper member engages the tape, the tape is attached to the upper, lower and side surfaces of the bag by the wipers applying pressure to attach the tape onto the corner and sides of the bag. When the wiper member is pivoted into position between the opening defined by the conveyer sections, it is located behind the tape and the wiper member is moved longitudinally along the bag to accomplish the sealing operation. At the same time that the wiper blade is moved, a blade cutter below the bag severs the tape below the bottom surface of the bag so as to leave a depending attached strip of tape available for the next operation. At the end of the longitudinal stroke of the wiper member to press the tape to the corner of the bag, another switch is operated to pivot the wiper arm outwardly to its initial position. As the wiper arm moves outwardly toward its initial position, a trigger switch actuates the tape mechanism to return the tape mechanism to its vertical, upward starting position and actuates another switch to open the gate members and start the conveyer belts to permit the next bag to enter for a sealing operation.

Referring now to the drawings in which an embodiment of the present invention is illustrated, FIG. 1 illustrates a bag with an adhesive tape attached to a corner for sealing and just prior to the sealing of the tape;

DESCRIPTION OF THE INVENTION

Figure 1:
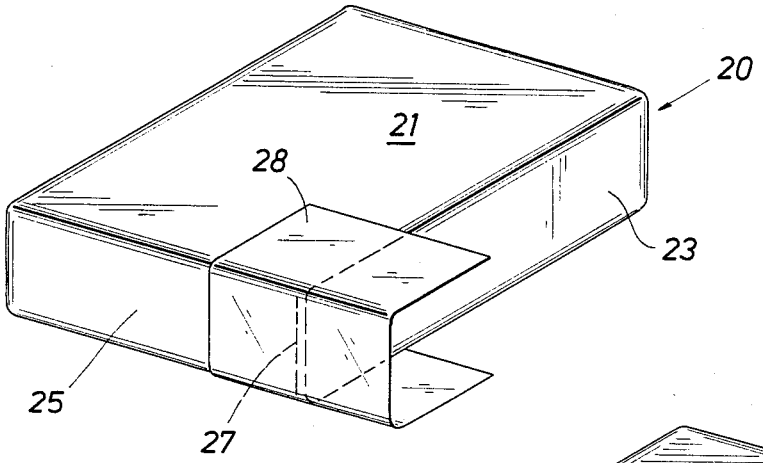

Referring now to FIG. 1, a bag or package container 20 to be sealed has an upper side 21, a bottom side 22, a right hand side 23, a left hand side 24, a bottom surface 25 and a top surface 26. (Some of the surfaces appear in other drawings). The bag 20 is constructed so that there is a bag opening 27 transverse to the bottom surface 25 (shown by the dash line). An injection nozzle (not shown) can be inserted into the opening 27 for filling the interior of the bag with the desired contents or chemicals.

Figure 2:
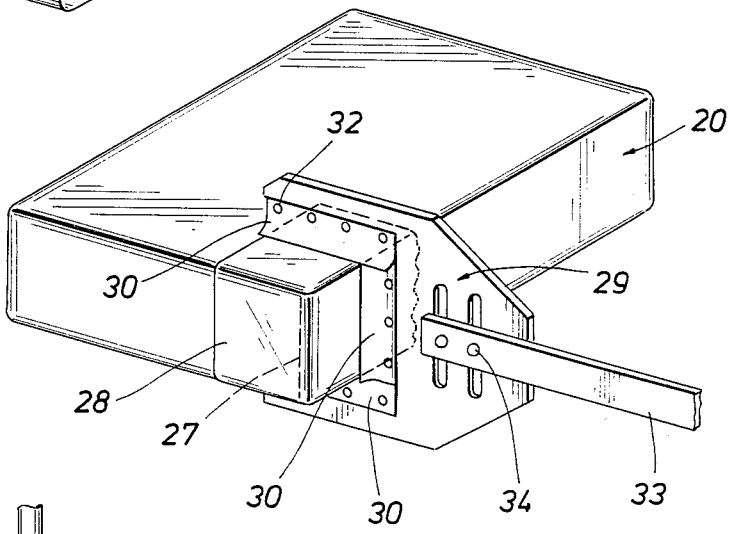
FIG. 2 illustrates the wiper member midway of the stroke as it applies the tape to the bag.

As shown in FIG. 1, after the bag 20 is filled, the opening 27 at the lower right hand corner of the bag 20 has an adhesive strip of tape 28 attached to the upper side 21, bottom surface 25, bottom side 22 and the right hand side 23. The system of the present invention applies the strip of tape 28 in one step of the operation. After applying the strip of tape 28, wiper blade 29 (FIG. 2) presses the tape to the bag.

The strip of tape 28 is applied to the bag 21 so that the approximately one-half of its width is attached to the bag and one-half of its width overhangs the side of the bag for sealing to the right hand side 23. With the strip of tape in position shown in FIG. 1, a U-shaped wiper blade 29 with rubber wiper members 30 is moved longitudinal of the bag 20 from a position behind the tape and the bottom surface 25 of the bag toward the top surface 26 of the bag. The blade 29 presses the strip of adhesive tape 28 to the sides of the bag. The U-shaped blade member 29 may be made of a flat metal plate 31 and the rubber wiper members 30 can be attached thereto by bolts or screws 32 into any convenient manner. The blade member 29 itself is attached to a blade arm 33 and is vertically adjustable by means of slots and bolts 34 to accomodate the location of bag on the conveyer belt. Thus, the system of the present invention is to apply a strip of tape to a bag and to press the tape onto the bag for a sealing relationship.

Figure 3:
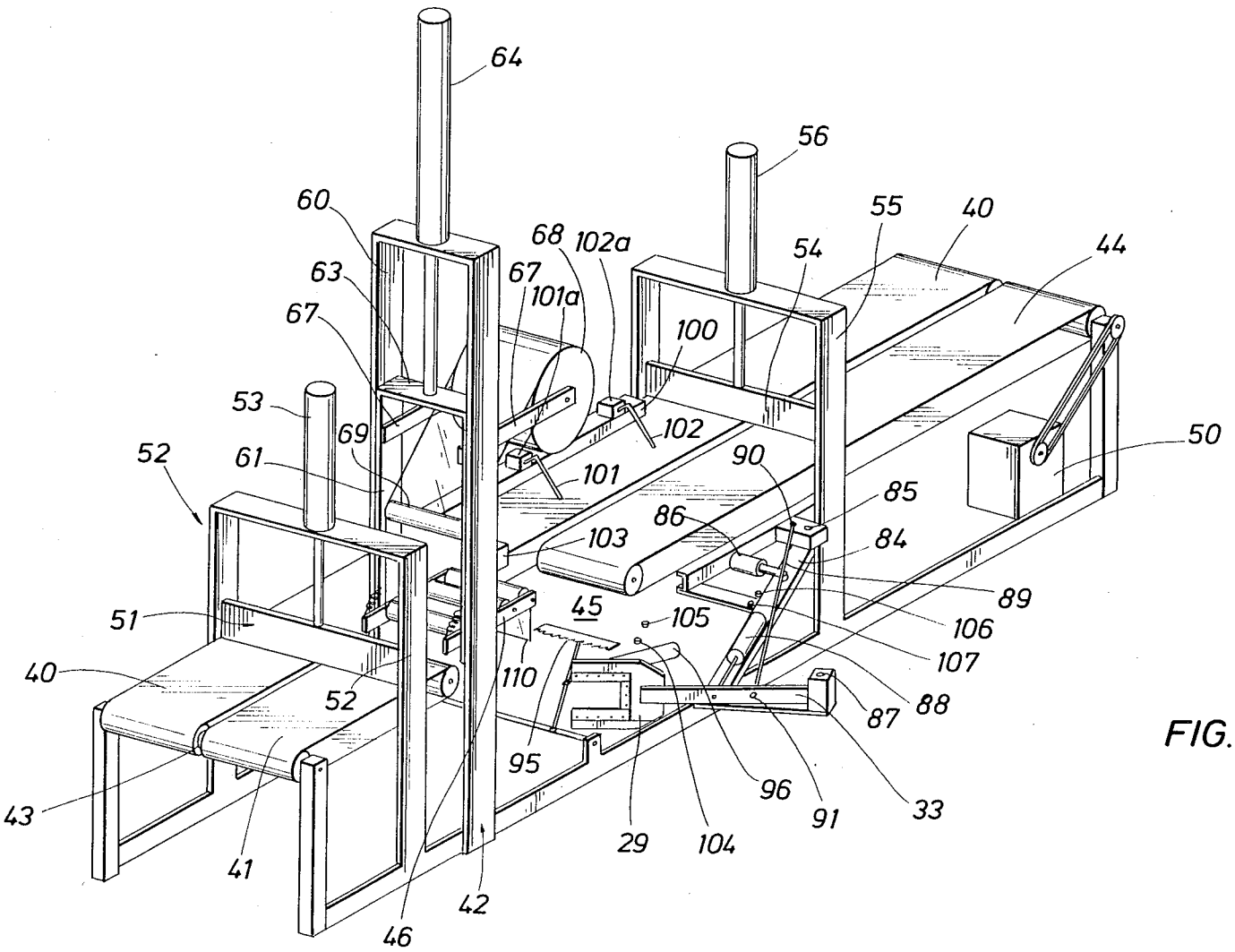
FIG. 3 illustrates a perspective schematic view of the apparatus of the present invention.

Referring now to FIG. 3, the system includes a first conveyer belt means 40 which extends the entire length of the apparatus and is suitably mounted on conveyer rollers along its length to support a transportion of bags thereon. The conveyer rollers as well as other structure is suitably mounted on a frame means which is only partially shown in the drawings for ease of illustration. It will be appreciated that the frame means provides structural support for the various components of the apparatus.

Adjacent to the first conveyer belt means 40 is a forward conveyer belt section 41 at the entry way of the apparatus which extends between the forward end of the first belt conveyer means 40 and a vertical frame 42. The conveyer belt means 40 and conveyer belt section 41 are linked to one another by a common drive shaft 43 so as to have a common drive. A rearward belt conveyer section 44 is located rearwardly of the vertical frame 42 and extends between the rearward end of the first conveyer belt means 40 and a location 45 spaced from an end of the belt conveyer section 41 so as to define a spaced opening between the forward and rearward conveyer belt sections 41 and 44 which is sized to permit access to a vertically reciprocating tape mechanism 46 mounted in the frame 42 and to the wiper blade 29. The forward and rearward belt sections 41, 44 comprise belt conveyer means in side by side relationship to the belt conveyer means 40. The conveyer belt means 40, 44 are driven by a motor 50. The conveyer belt means and other structure are supported by a frame means (not shown) which is conventional.

At the forward end of the side by side belt conveyer means is a transverse forward gate member 51 which is rectangular in shape and mounted with respect to vertical guideways 52 so as to be moveable vertically by means of a piston and cylinder 53. The forward gate member 51 is shown in a down position and can be raised in the vertical guideways 52 a sufficient distance for a bag to pass under the gate member 51.

At the rearward end of the side by side belt conveyer means is a transverse rearward gate member 54 which is rectangular in shape and mounted in vertical guideways 55. The rectangular shaped gate member 54 is vertically moveable by means of a piston and cylinder 56. The forward and rearward gate members 51, 54 are shown in a down position which blocks the passage of a bag into the apparatus and holds a bag in position for sealing. Both of the gate members 51, 54 are operated simultaneously by conventional piston and cylinders 53, 56 to raise and lower the gate members, as will be explained more fully hereinafter. While not shown, conventional side rails are appropriately provided on the frame means to prevent the bag from falling off the conveyer belt means.

Just rearward of the first gate member 54 is a vertically disposed frame member 42 which has vertical guideways 60 to slidably carry a taping mechanism 46. The side guide bars 61, 62 of the taping mechanism are slidably mounted in guideways 60 and are attached to a horizontal crossbar 63 which is, in turn, coupled to a piston and cylinder 64 for accomplishing vertical movement of the tape mechanism between an upper position shown in the drawings and a lower position in the vertical frame 42.

Figure 4:
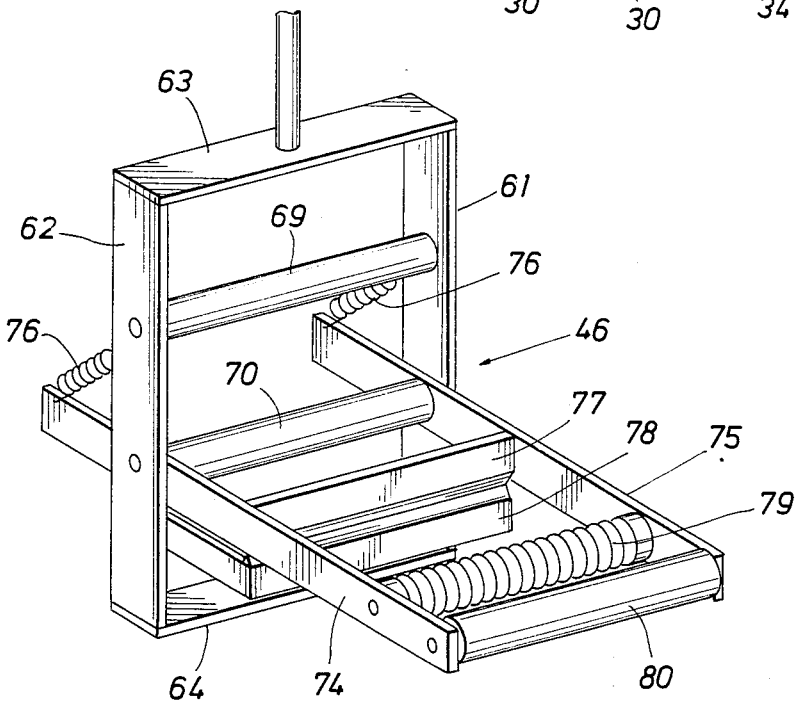
FIG. 4 illustrates a perspective schematic view of the tape mechanism of the present invention.

The taping mechanism 46, as illustrated in FIGS. 3 and 4, includes the vertical guide members 61, 62, a top horizontal cross bar 63 and a lower horizontal cross bar 65. As shown in FIG. 3, near the top of the guide members 61, 62 transverse upper bar members 66, 67 are attached to the guide members 61, 62. The upper pair of bar members 66, 67 support a roll of adhesive tape 68 which furnishes the supply of tape for the system. Midway of the vertical length of the side guide bars 61, 62 is a first, upper roller 69 which is rotatively mounted between the guide bars 61, 62. A second lower roller 70 is located between the guide bars 61, 62 near the lower end of the guide bars and is rotatively mounted with respect to the guide bars. A pair of pivotally mounted, horizontally disposed arm members 74, 75 are pivotally attached to the guide bars 61, 62 at the location of the lower roller 70. Springs 76 are attached between the rearward ends of the horizontal arm members 74, 75 (which extend outwardly with respect to the guide bars 61, 62) and the vertical guide bars 61, 62 to resiliently bias the opposite ends of the arm members 74, 75 in a downward direction. Extending between the arm members 74, 75 is an upper transverse gripping member 77 which normally engages a lower transverse gripping member 78 by virtue of the spring bearing of the arms 74, 75. The lower gripping member 78 is attached to the guide bars 61, 62. The springs 76 normally bias the upper gripping member 77 against the lower gripping member 78 so that tape is locked in position by the gripping members 77, 78. At the forward end of the arm members 74, 75 are a pair of adjacent rollers 79, 80. The rearward roller 79 has a series of annular grooves across its length because the adhesive side of the tape bears upon the roller 79 and the grooves prevent sticking. The forward roller 80 is used to apply tape to a bag as will hereinafter become apparent.

The roll of adhesive tape 68 mounted on the side bars 67, 68 issues the tape with the adhesive side outward of the roll 68 (toward the entry side of the apparatus) and is passed over the upper roller 69, the lower roller 70, between the gripping members 77, 78 and over the upper side of the grooved roller 78 to provide a free end 110 which hangs downwardly between the two rollers 79, 80. The amount of tape which hangs downward from the grooved roller 79 is sufficient to overlap and be engaged by a top surface 21 of a bag when it passes underneath the tape mechanism 42.

Attached to the side of the apparatus frame is an elongated, pivotably mounted, "L" shaped arm member 84 which is moved about its pivot point 85 on the frame means by means of a piston and cylinder 86 attached to the arm member 84 and a frame support (not shown) on the frame means of the apparatus. The arm member 84, in turn, carries a pivotable blade arm 33 which is pivoted at one point 87 on the arm member 84. The wiper blade 29 at the other end of the blade arm 33 is adapted to be received within the opening between the second and third conveyer belt sections 41, 44. Mounted on the arm member 84 is a piston and cylinder 88 which is respectively connected between the arm member 84 and the blade arm 33. The piston and cylinder 88 normally urges the pivotable blade arm 33 away counterclockwise around the pivot point 87. A second pivoted arm member 89 extends across from a pivot point 90 on the frame means and passes freely through an opening in the blade arm 33. A bolt 91 on the end of the arm member 89 limits the counterclockwise movement of the blade arm 33 relative to the arm member 89. The pivot point 90 is located closer to the frame than the pivot point 85 and so that arm member 89 passes across the arm member 84 to a point midway of the length of arm 33. Thus, when the arm member 84 pivots clockwise, the piston member 88 urges the blade arm 33 counterclockwise against the bolt 91 and keeps the blade arm 33 extended away from the pivot point 85.

Below the conveyer belts and located above the opening and relative to the tape mechanism, is an elongated cutter blade 95 with serrated teeth, the blade 95 is pivotably mounted on the frame means and actuated by piston and cylinder 96. The cutter blade 95, when actuated, severs the tape after the tape has been afixed to the bag, as will be hereinafter explained.

A transverse arm 100 extends horizontally above the conveyer belt means and carries triggering switches 101, 102 which are adapted to be engaged by a bag and to actuate switching mechanisms. The arm 100 is attached to the frame.

There are a number of switching mechanisms on the apparatus, the purposes of which will become more apparent hereinafter. Briefly, in order of operational sequence, the following switching means are shown in FIG. 3:

(1) Switching means 101 which is operated by the toggle arm 101*a*. Toggle arm 101*a* is pivotally mounted on the arm 100 which is horizontal and attached to the vertical frame 42 above the conveyer belt section 44 so that a bag can be passed under the arm 100 and engage the end of the toggle arm 101*a*. Arm 100 is located approximately in the center of the conveyer belt section 44. The switching means 101 is adjustably mounted on the arm 100 so that it can be positioned to accomodate various bag lengths. Switching means 101 actuates piston and cylinders 53, 56 to lower the gate members.

(2) Switching means 102 which is operated by a toggle arm 102*a*. Toggle arm 102*a* is pivotally mounted on the arm 100 at a location near the rearward gate member 54. The bag engages arm 102*a* to actuate switching means 102. Switching means 102 is adjustably mounted on an arm 100. Switching means 102 stops the conveyers and actuates the piston and cylinder 64 to move the tape mechanism 46 downwardly.

(3) Switching means 103 which is engaged by the horizontal bar 67 when the tape mechanism 46 is in its lowermost position. Switching means 103 actuates the piston and cylinder 88 to move the arm member 84 inwardly.

(4) Switching means 104 which is engaged by the arm member 84 when it swings into a position parallel to the conveyer belt section 44 where the wiper blade 29 is positioned behind the tape 81. Switching means 104 actuates the piston and cylinder 88 to move the wiper blade 29 along the bag.

(5) Switching means 105 positioned on the arm member 84 which is engaged by the blade arm 33 at the end of the stroke of the blade arm 33. Switching means 105 reverses the movement of piston and cylinder 86 to return the arm member 84 to its initial position.

(6) Switching means 106 which is operated as the arm member 84 pivots counterclockwise to return the wiper blade 29 to its vertical position. Switching means 106 reverses the movement of piston and cylinder 64 to return the tape mechanism 42 to its upper position and reverses the movement of piston and cylinder 96 to return the cutter blade 95 to its initial position.

(7) Switching means 107 which is actuated by the arm member 84 while the arm returns to its initial position to initiate the opening of the gate members 51, 54 and to start the conveyer motor 50. Switching means 107 reverses the piston and cylinders 53 and 56 to return the gate members to an upper position.

Figure 5:
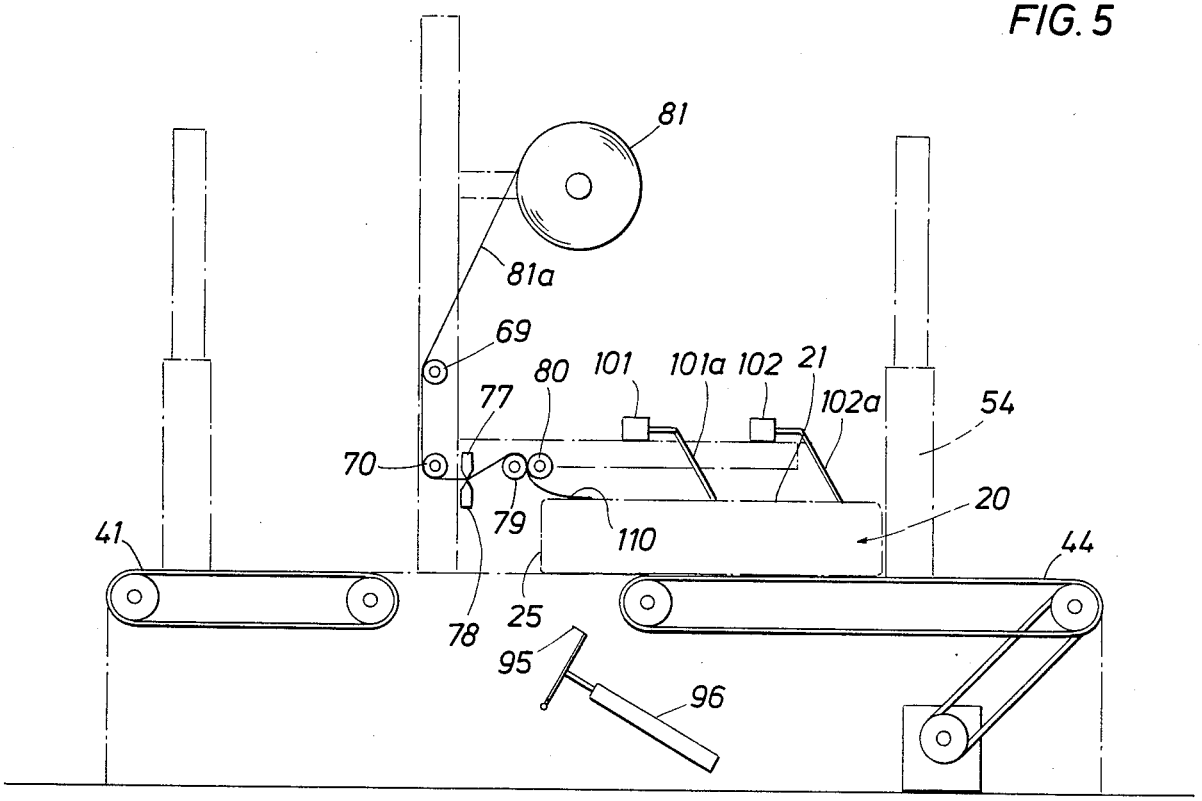
FIG. 5 illustrates a schematic illustration of a bag in position in the apparatus just prior to the operation of the tape mechanism.
Figure 6:
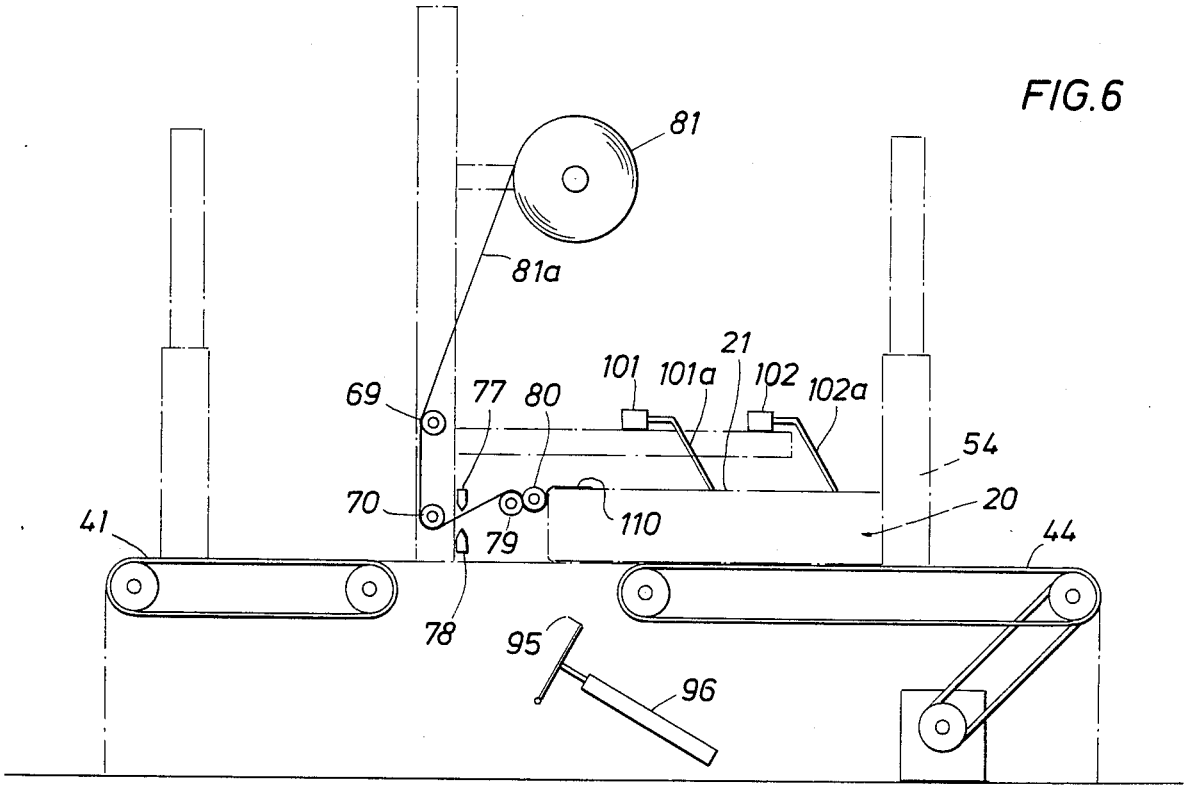
FIG. 6 illustrates the tape mechanism in an initial position while moving downward to apply the tape to the corner of the bag.
Figure 7:
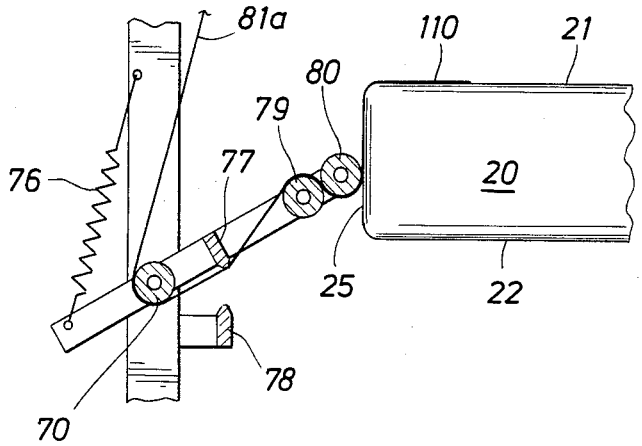
FIG. 7 illustrates in schematic a portion of the tape mechanism and the application of the roller and lock assembly to apply the tape to the end of the bag.
Figure 8:
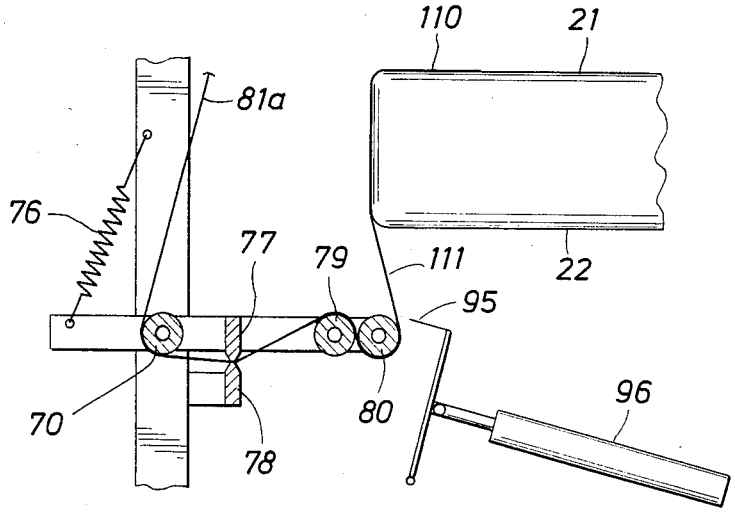
FIG. 8 illustrates the roller of the tape mechanism in a lowermost position where the tape is applied to the ends of the bag and the cutter is in position for cutting the tape.

As shown in FIG. 3, there is a depending tape flap 110 with an adhesive side facing toward the front of the apparatus. As a bag passes through and under the tape mechanism 46, the tape flap 110 slides across the upper side 21 of the bag. Thus, as shown in FIG. 5, when the bag reaches the rearward gate member 54, the tape flap 110 lies on the upper side 21 of the bag 20 with the adhesive side face down on the upper side 21 of the bag. Approximately one-half of the tape extends outwardly over the right hand side 23 of the bag as shown in FIG. 1. The tape 81*a* in this position extends from the tape roll 81 over the upper roller 69 around the lower roller 70 and is gripped between the locking gripping members 77, 78 and passes over the roller 79 and between rollers 79, 80. The actuation of the second switching means 102*a* begins the downward travel of the tape mechanism 46 and the outer roller 80 engages the upper side 21 of the bag to press the tape flap 110 onto the upper side 21 of the bag. As the tape mechanism 46 moves downwardly, the arms 74, 75 (See FIG. 4) are pivoted to unlock the tape and the roller 80 travels toward the bottom surface 25 of the bag (See FIG. 6). Upon reaching the bottom surface 25 of the bag the roller 80 moves down the bottom surface of the bag as shown in FIG. 7. When the arms 74, 75 first begin to tilt upwardly, the gripping members 77, 78 release the tape 81*a* so that it may be unrolled from the tape roll 81. When the outer roller 80 reaches the bottom side 22 of the bag, the spring members 76 (FIG. 4) bias the bars 74, 75 and rollers 80 to a normally horizontal position below the bag where the gripper member 77, 78 once again grip the tape 81*a* and a depending flap portion 111 of the tape is disposed between the roller 80 and bag and is positioned relative to the cutter blade 95. When the cutter blade 95 is actuated, the tape flap portion 111 is then cut to leave a tape portion on the bag as illustrated in FIG. 1. The portion of the tape between the cutter blade 95 and roller 80 falls downwardly to provide a flap portion 110 be ready for the next operation.

The operation of switching means 103 causes the arm member 84 to pivot inwardly toward a parallel position whith respect to the conveyer belt section.

Figure 9:
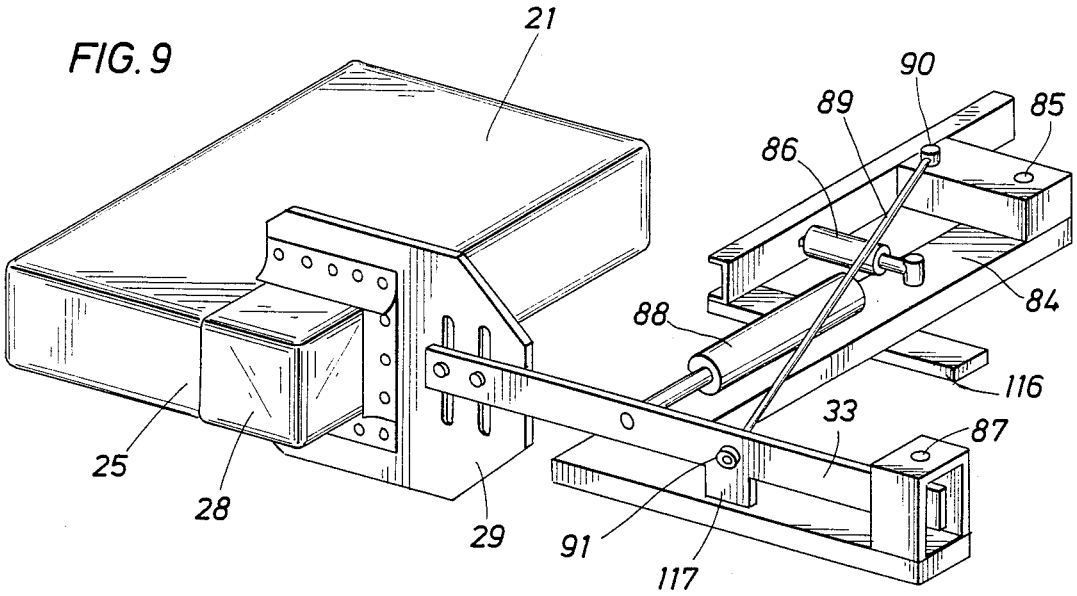
FIG. 9 illustrates a perspective schematic view of the tape wiper mechanism.
Figure 10:
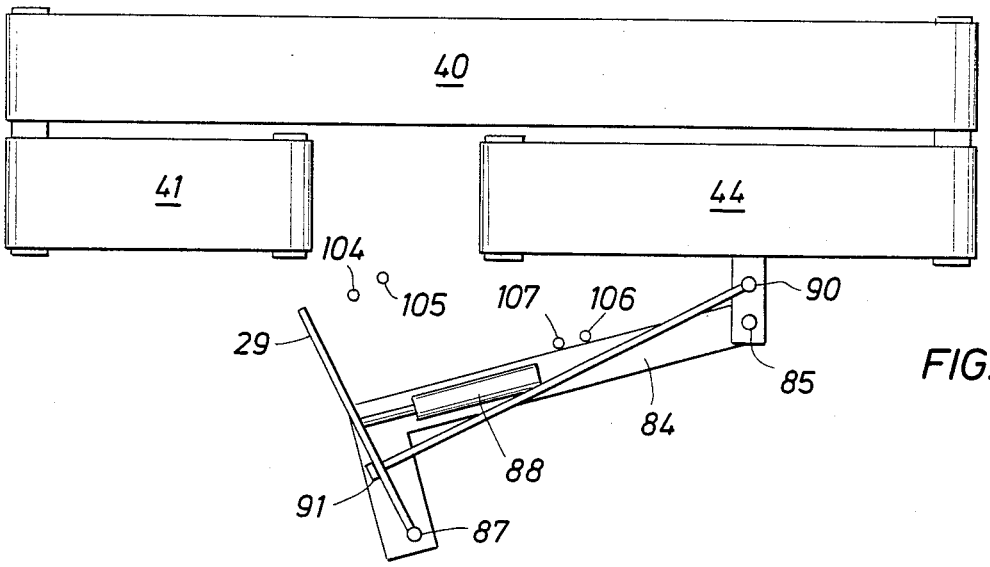
FIG. 10 illustrates a plan schematic view of the wiper mechanism in its initial position relative to certain operating switches.
Figure 11:
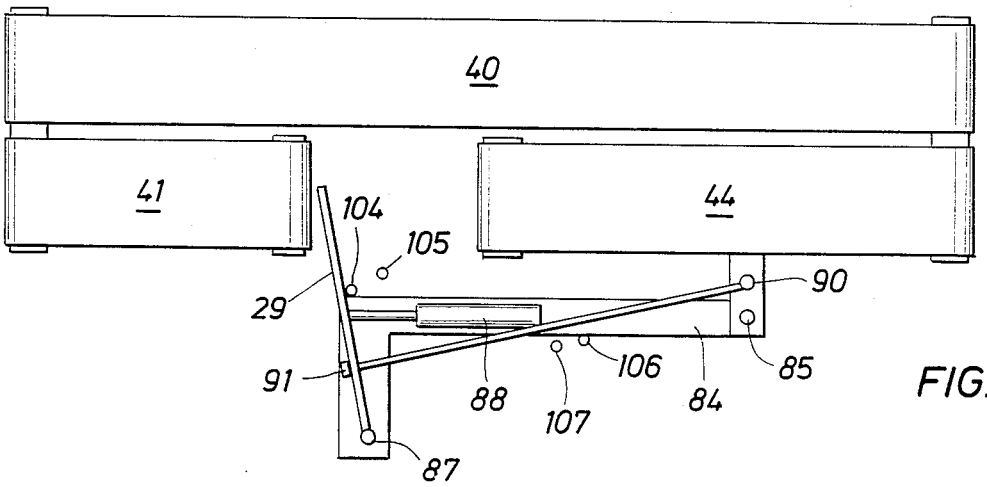
FIG. 11 illustrates the wiper arm of FIG. 10 in a position where the wiper is located relative to the tape to apply the tape to the end of the bag.
Figure 12:
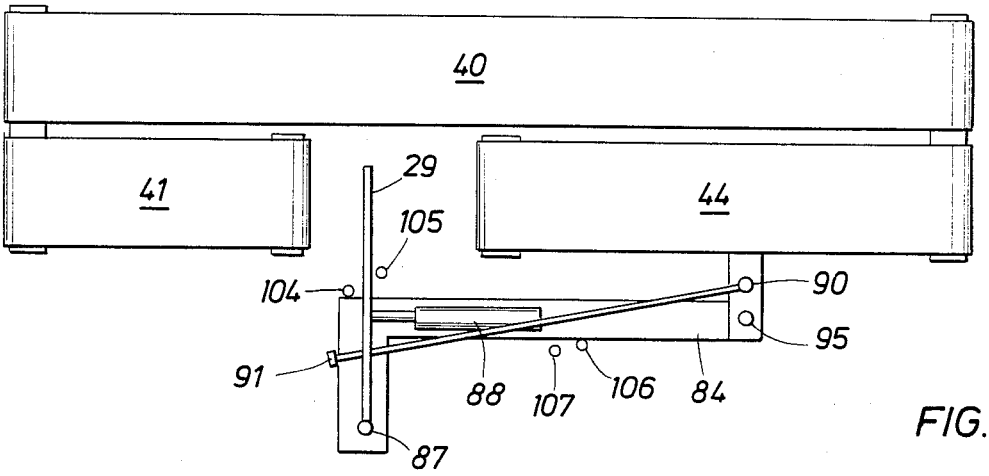
FIG. 12 illustrates a view similar to FIG. 11 with the wiper blade beginning its traverse of a bag.

The arm member 84, as illustrated in FIG. 9, is pivoted about a pivot point 85 located rearwardly of the vertical frame 42 and is attached to a side frame member (partially shown). The arm member 84 is "L" shaped. Midway of the length of the arm member 84 is a support member 116 which slidably supports the arm member 84. The support member 116 is transverse with respect to the arm member 84. At the end of the arm member 84 is a pivot point 87 which pivotally mounts the blade arm 33. Between the blade arm 33 and arm member 84 is a slidable block member 117 which is attached to the blade arm 33 and slides on the arm member 84. The piston and cylinder 88 on the arm member 84 is attached to the blade arm 33 to move the blade arm 33 relative to the arm member 84. Normally the blade arm 33 is urged in a counterclockwise direction so that blade arm 33 is pushed against the bolt on the arm member 89 to assure positioning of the wiper blade 29 behind the tape. When the blade arm 33 is in its operating position and the blade 29 is positioned behind the bag, operation of switch 104 actuates the piston and cylinder 88 to move the wiper blade 29 across the tape and applies the tape to the three sides of the bag. At the end of the stroke of the wiper blade 29, switch 105 operates the piston and cylinder 86 to move the arm member 84 to its starting position. Return to the starting position actuates the switches 106, 107 by movement of the arm member 84. As shown in FIG. 10, the pivoting of the arm member 84 and the movement of the wiper blade 29 inwardly toward the conveyer belt section maintains the tip of the wiper blade behind the tape so that subsequently the operation of the piston and cylinder 88 will move the wiper blade 29 over the tape on the bag.

Figure 13:
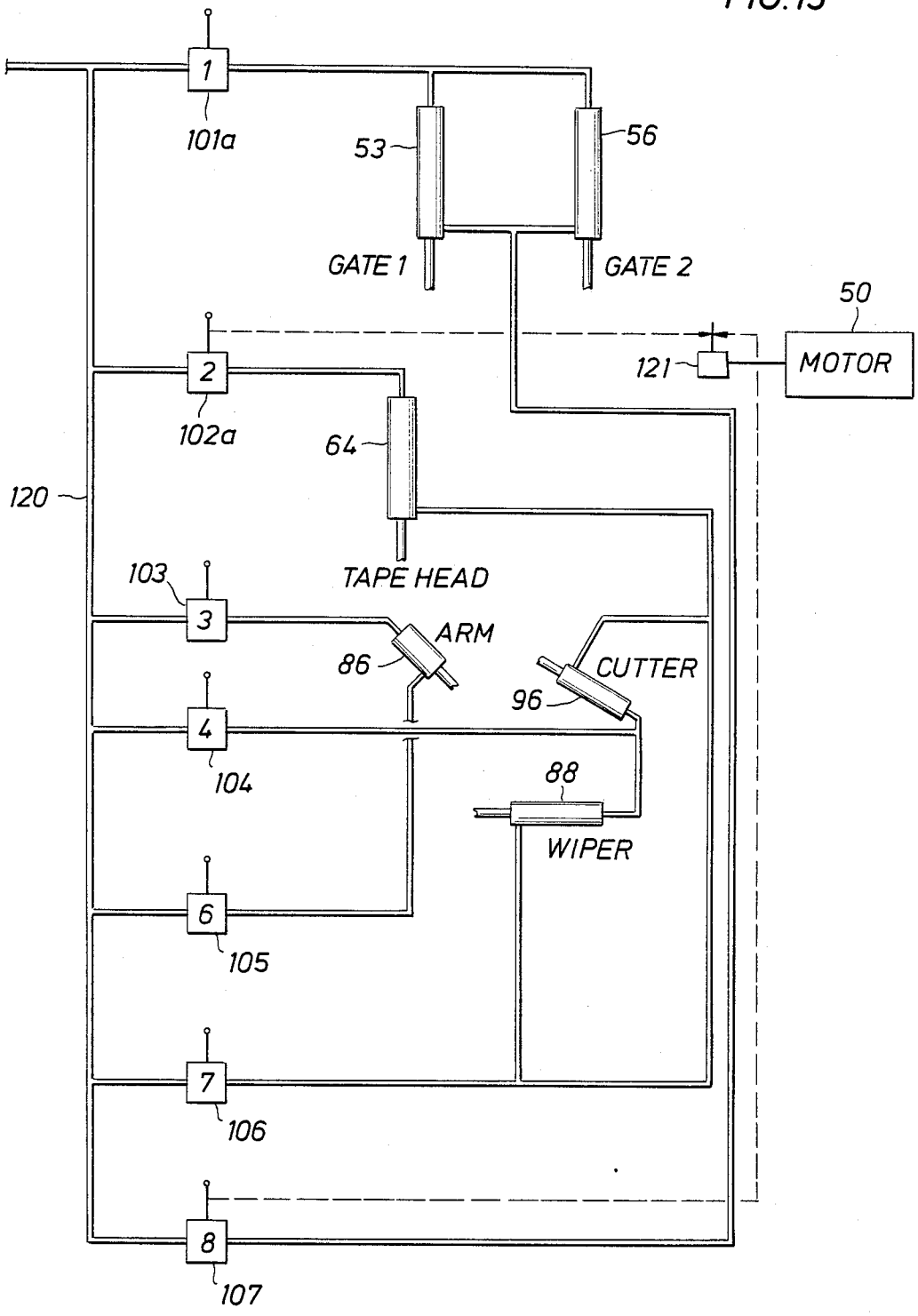
FIG. 13 illustrates a control system for operation of the various components of the invention.

As shown in FIG. 13, a common air supply system 120 is supplied to the switching means which are wand actuated pressure control valves. The valves 101*a*, 102*a*, 103–107 are operated by triggering caused by the various engagements, as have been previously explained. The switch means 101*a* couples air to one side of the piston and cylinders 53, 56 for moving the gate members 51, 54 to an upper position to permit entry of a bag to the system and release of a bag from the system. The switch means 102*a*, when actuated, stops the conveyer belt motor 50 by operating a switch 121 and actuates the piston and cylinder 64 for the tape mechanism 46. The switching means 103 is actuated when the tape mechanism 46 is in its lowermost position to actuate the piston and cylinder 86 to move the arm member 84 into position where the wiper blade 29 behind the tape. When the arm member 84 reaches its final position, the switching means 104 actuates the piston and cylinders 96 and 88 so that the tape is cut by blade 95 and the wiper blade 29 is moved lengthwise of the bag to apply the tape to the tape. Upon the wiper blade 29 reaching the end of its movement, switching means 105 resets the piston and cylinder 86 to move the arm member 84 to its initial position. As the arm member moves to its initial position, the switching means 106 resets the piston and cylinder 88 and the wiper blade 29 and the piston and cylinder 96 for the cutter blade 95 and the piston and cylinder 64 for the tape mechanism 46. Near the end of the movement of arm member 84, the switching means 107 starts the motor 50 for the conveyers belts and resets the piston and cylinders 53, 56 for the gate members. As will be appreciated, the switching means are positively engaged for operation and upon release, return to an initial position.

While various embodiments are illustrated, the scope of the invention is included within the claims which follow.

I claim:

1. A method for applying an adhesive sealing tape to the corner of a package member from a roll of adhesive sealing tape including the steps of:

overlaying the end of an adhesive sealing tape from a roll of adhesive tape so that a lengthwise part of the sealing tape lies on the upper horizontal surface of a package member and the other lengthwise part extends outwardly away from the vertical side surface of the package member;

applying sealing pressure to the lengthwise part of the sealing tape on the upper surface of the package member for affixing that lengthwise portion of sealing tape to the upper surface and continuously applying a lengthwise part of the sealing tape to the vertical end surface and to the horizontal bottom surface of the package member while applying sealing pressure to affix that portion of the sealing tape to the package member until the sealing tape is extended to a location below the horizontal bottom surface package member while the other lengthwise part extends outwardly away from the vertical end surface and the bottom surface;

severing the sealing tape from the roll of adhesive sealing tape at a location below the horizontal bottom surface of the package member; and simultaneously applying a wiping pressure to the other lengthwise part of the sealing tape with respect to the upper, bottom and side surfaces of the package member to sealingly apply pressure to the sealing tape with respect to the upper, bottom and side surfaces of the package member.

2. The method as defined in claim 1 wherein the step of overlaying the adhesive tape member includes:

disposing a depending end of a sealing tape vertically to a location below the upper surface of a package member;

moving the package member on a conveyer belt means for engaging the vertically depending strip of the sealing tape so that said depending strip of said sealing tape slides on the upper surface of the package member; and stopping the conveyer belt means so that the depending strip of sealing tape extends from an end on the upper surface of a package member to a position rearward of the end surface of the package member.

3. The method as defined in claim 2 and further wherein the step of applying sealing pressure includes:

moving a pressure applying means along the lengthwise part of the sealing tape on the upper surface of the package member for adhesively affixing the lengthwise part of said depending strip of sealing tape to the upper surface of the package member; and moving a pressure applying means from the upper surface of the package member and downward along the end surface of the package member while supplying a lengthwise part of the sealing tape from the roll of sealing tape in alignment with the end surface of the package member until the sealing tape is disposed below the package member.

4. The method as defined in claim 3 and further wherein the step of applying a wiping pressure includes:

moving a U-shaped wiper blade into engagement with the sealing tape and simultaneously applying pressure to the sealing tape on the upper, lower and side surfaces of the package member.

5. Apparatus for applying tape to the corner of an elongated container comprising:

conveyer belt means for conveying containers through said apparatus;

taping means for selectively applying from a roll of adhesive sealing tape a continuous lengthwise portion of adhesive sealing tape to the upper surface, end surface and bottom surface of a corner of a container on the conveyer belt means, means on said taping means for supporting a supply roll of adhesive sealing tape, said taping means being located relative to the conveyer belt means to leave a portion of the adhesive tape extending over one side of a container;

cutter means for selectively severing an applied strip of adhesive sealing tape from a roll of adhesive sealing tape at a location below a container on a container belt; and wiper means for simultaneously applying pressure to an applied strip of adhesive sealing tape along the upper surface, lower surface and side surface of a container for bringing the portion of the adhesive tape extending over the one side of the container into sealing contact with respect to the container.

6. The apparatus as defined in claim 5 wherein said taping means includes roller means for guiding a strip of adhesive sealing tape from a supply roll of sealing tape and for providing a depending end flap of sealing tape at a position above said conveyer belt means, and pressure applying means for pressing sealing tape on a container from the end flap to a location below a container.

7. The apparatus as defined in claim 5 including means for selectively operating said conveyer means, taping means, said cutter means and said wiper means in a repetitive sequence for continuously applying sealing tape to the corner of containers."

8. An apparatus for taping the corner of an elongated container including:

conveyer belt means for conveying containers through said apparatus, said apparatus including at least two separate locations for defining a container space along the length of said conveyer belt means;

taping means at one of said locations for applying adhesive sealing tape to the corner of a container when a container is on the conveyer belt means in said container space, said taping means including a vertically reciprocating tape frame means for reciprocating between a first vertical position and a second vertical position, said tape frame means having means for supporting a roll of adhesive sealing tape so that an unrolled portion of such adhesive sealing tape can have a loose end flap disposed above the conveyer belt means whereby the upper surface of a container can be overlayed with the end flap when said frame means is in said first position, said taping means being located relative to the conveyer belt means so that a lengthwise portion of adhesive sealing tape would extend over the vertical side of a container;

means on said tape frame means for applying pressure to an end flap of sealing tape on the upper surface of a container and for applying pressure to a sealing tape from a roll of sealing tape along a vertical end surface of a container and for extending sealing tape from a roll of sealing tape to a location below the bottom surface of a container when said tape frame means moves between said first and second vertical positions;

cutter means below said conveyer belt means for severing sealing tape applied to a container from sealing tape on a roll so that a roll of tape would have a depending loose end flap on the tape frame means for application to a subsequent container supplied to the apparatus;

wiper means extendable into and out of said container space, said wiper means being moveable longitudinally of said conveyer belt means when said wiper means is in said container space for applying pressure to portions of a sealing tape which extends over the side of a container and for applying pressure to portions of sealing tape which extend over the side of a container; and means for moving said wiper means into and out of said container space and for moving said wiper means longitudinally of said conveyer belt means longitudinally of a container on said conveyer belt means.

9. The apparatus as defined in claim 8 including a rearward stop means at the other of said locations disposed transversely across said conveyer belt means, said rearward stop means being located relative to said tape frame means so that a loose end flap of a sealing tape can contact the upper side of a container when a container engages said rearward stop means.

10. The apparatus as defined in claim 9 and further including a forward stop means disposed transversely across said conveyer belt means, said forward stop means being located relative to said tape frame means for selectively stopping a container from being moved by the conveyer belt means while another container is in the container space.

11. The apparatus as defined in claim 8 wherein said:

means for applying pressure on said tape frame means includes a pair of cooperative roller means for moving a sealing tape from a roll of sealing tape to a location for engaging the end of a container;

means mounting said rollers for pivotal movement with respect to said tape frame means whereby, as said tape frame means moves between said first vertical position and said second vertical position, one of said rollers is disposed so as to engage at least the upper surface of a container, and the end surface of a container.

12. The apparatus as defined in claim 11 and further including:

clamping means disposed on said tape frame means between means for supporting a roll of tape and said cooperative rollers means for initially selectively clamping a sealing tape against movement relative to said roller means, said clamping means being operative in response to a roller means engaging the upper surface of a container for releasing said clamping means and being operative in response to a roller means clearing the bottom surface of a container for returning said clamping means to their initial position.

13. The apparatus as defined in claim 8 wherein said wiper means includes a U-shaped blade member adapted to frictionally engage the upper, lower and side surfaces of a container for applying pressure to adhesive sealing tape, first arm means coupled to said blade member;

second arm means pivotally mounted with respect to said apparatus for pivotal movement toward and away from said conveyer belt means;

means pivotally coupling said first arm means to said second arm means so that when said second arm is moved to a position toward said conveyer belt means said second arm means is pivoted counterclockwise to be positionable behind a container on a conveyer belt means, said second arm means being pivotable in a clockwise direction to move longitudinally of a container.

14. The apparatus as defined in claim 8 including actuator means disposed along said conveyer belt means for stopping said conveyer belt means in response to a container position on said conveyer belt means and for moving said tape frame means between said vertical positions, and means responsive to movement of said tape frame means for actuating said cutter means and for moving said wiper means into said container space;

means responsive to said wiper means moving into said container space for moving said wiper blade member longitudinally of said conveyer belt means; and means responsive to said wiper blade reaching the end end of its stroke for moving said wiper blade member out of said container space, means responsive to movement of said wiper blade member out of said container space for starting said conveyer belt means and for returning said tape frame means to its vertical position.

* * * * *